US006796092B1

(12) United States Patent
Goebel

(10) Patent No.: US 6,796,092 B1
(45) Date of Patent: Sep. 28, 2004

(54) DEVICE TO COLLECT MOISTURE FROM OPEN DECKS

(76) Inventor: William David Goebel, 47503 Belford Ct., Canton, MI (US) 48187-1246

( * ) Notice: Subject to any disclaimer, the term of this patent is extended or adjusted under 35 U.S.C. 154(b) by 0 days.

(21) Appl. No.: 10/214,432

(22) Filed: Aug. 7, 2002

Related U.S. Application Data

(60) Provisional application No. 60/310,585, filed on Aug. 7, 2001.

(51) Int. Cl.[7] ..... E04B 1/70; E04F 17/00; E04F 17/04; E04F 17/08

(52) U.S. Cl. ..... 52/302.1; 52/302.3; 52/462; 52/14; 52/463

(58) Field of Search ..... 52/302.1, 302.3, 52/11, 13, 15, 462, 302.6, 14, 463, 464

(56) References Cited

U.S. PATENT DOCUMENTS 4,065,883 A 1/1978 Thibodeau
4,663,894 A * 5/1987 LaRoche et al. ..... 52/15
4,860,502 A 8/1989 Mickelsen et al.
5,195,281 A 3/1993 Kosko
5,511,351 A 4/1996 Moore
6,105,323 A * 8/2000 Paulle ..... 52/302.1
6,164,019 A * 12/2000 Salley ..... 52/11
6,212,837 B1 * 4/2001 Davis et al. ..... 52/302.1
6,244,007 B1 * 6/2001 Heikkila ..... 52/302.3
6,415,571 B2 7/2002 Risser
6,421,967 B1 * 7/2002 Wlaker ..... 52/198
6,598,353 B1 * 7/2003 Reeves ..... 52/57

* cited by examiner

*Primary Examiner*—Chi Q. Nguyen
(74) *Attorney, Agent, or Firm*—Dykema Gossett PLLC

(57) ABSTRACT

In an open planked deck a plurality of deck pans thereunder collect moisture and are supported by the deck joists. The deck pans are shaped to direct the moisture as water to a collecting trough which, in turn, directs the water to a vertical drain pipe or downspout. For new construction, the deck pans are joined to fit over parallel adjacent joists and are held in place by the deck planking there over. For existing decks, the deck pans are attached to the sides or undersides of the adjacent joists. The deck pans and collecting troughs are formed with specific pitches of prevent collection of standing water in the pans or troughs.

10 Claims, 7 Drawing Sheets

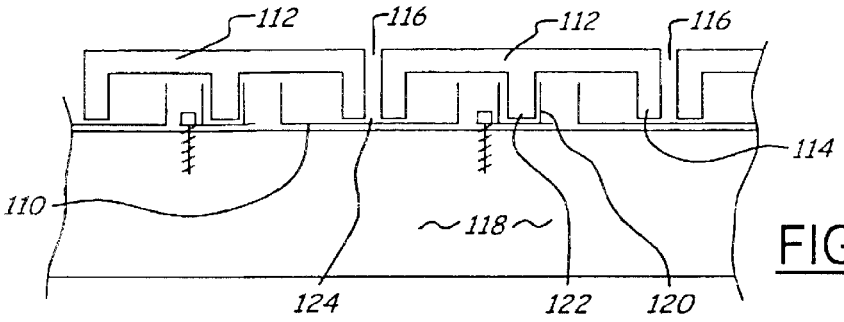
FIG. 16A
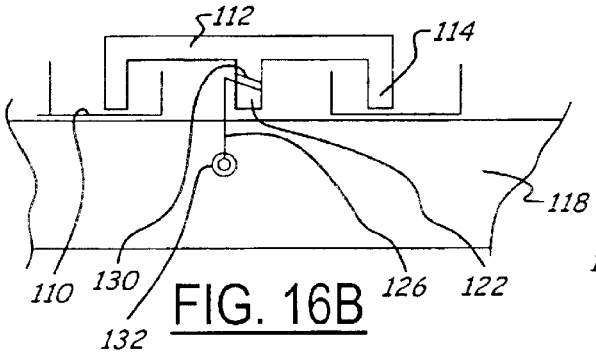
FIG. 16B
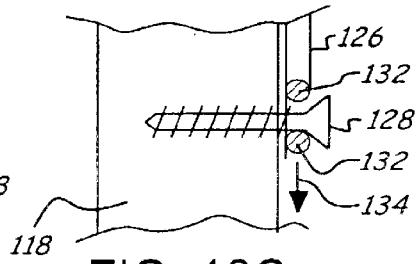
FIG. 16C
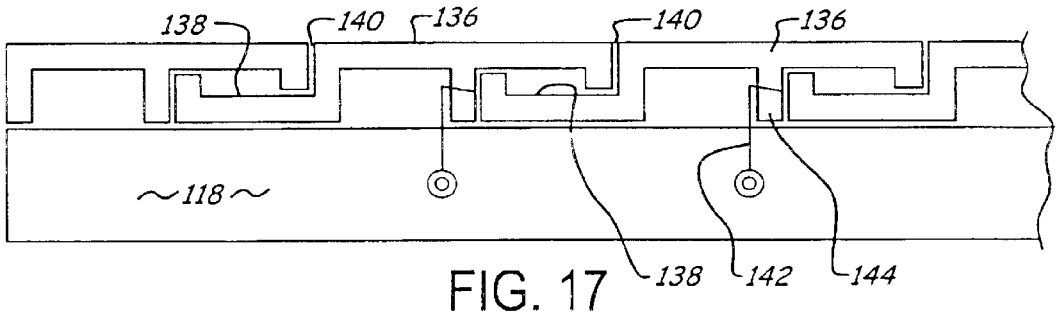
FIG. 17
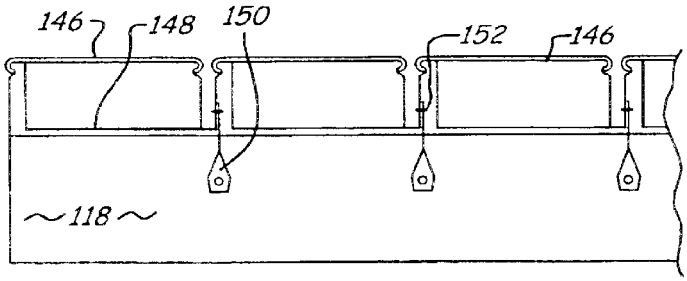
FIG. 18A
FIG. 18B
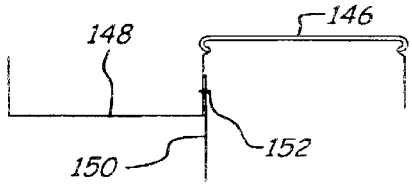

DEVICE TO COLLECT MOISTURE FROM OPEN DECKS

This application claims the benefit of provisional patent application No. 60/310,585, filed Aug. 7, 2001.

BACKGROUND OF THE INVENTION

The field of the invention pertains to open decks usually made of wood that are commonly attached to modern homes. The decks are used for outdoor relaxation and entertainment and may be constructed from a few inches to many feet above ground. The decks are planked with gaps of one quarter inches or less to allow for expansion and contraction of the planks. As a result, water and small debris passes between and falls onto whatever is below the deck.

Absent the water draining from the deck, the space beneath the deck can be used as dry storage for a variety of purposes, depending on the height above the ground. Storage of various outdoor furniture items, portable barbecues used on the deck and yard maintenance items could be stored out of the rain and in the off season, for example. Where the deck is a significant distance from the ground, the deck could serve as a carport or open boat house. Thus, an economical, unobtrusive and effective device to collect water passing between the planks of a deck would be a desirable addition to a new or existing deck.

SUMMARY OF THE INVENTION

The new device comprises a plurality of deck pans supported by the deck joists and shaped to direct the moisture to a collecting trough which, in turn, directs the water to a vertical drain pipe or downspout. For new construction, the deck pans are joined to fit over parallel adjacent joists and are held in place by the planking applied thereover. For existing decks, the deck pans are attached to the sides or undersides of the adjacent joists. The deck pans and troughs are formed with specific pitches to minimize collection of standing water in the deck pans and troughs. The deck pans may be ganged to extend their length.

The new device includes various optional features to reduce or eliminate the exposure of the joists, headers and other structural members to moisture. These features have become particularly important in view of the severe future reductions and bans on the use of heavy metal compounds to treat lumber to prevent decay.

BRIEF DESCRIPTION OF THE DRAWINGS

FIGS. 16A, 16B and 16C illustrate alternative deck pans and fastening means for molded composite deck planks;

FIG. 17 illustrates composite deck planks having integral deck pans; and

FIGS. 18A and 18B illustrate metal deck units combined with supporting deck pans.

DESCRIPTION OF THE PREFERRED EMBODIMENTS

Figure 1:
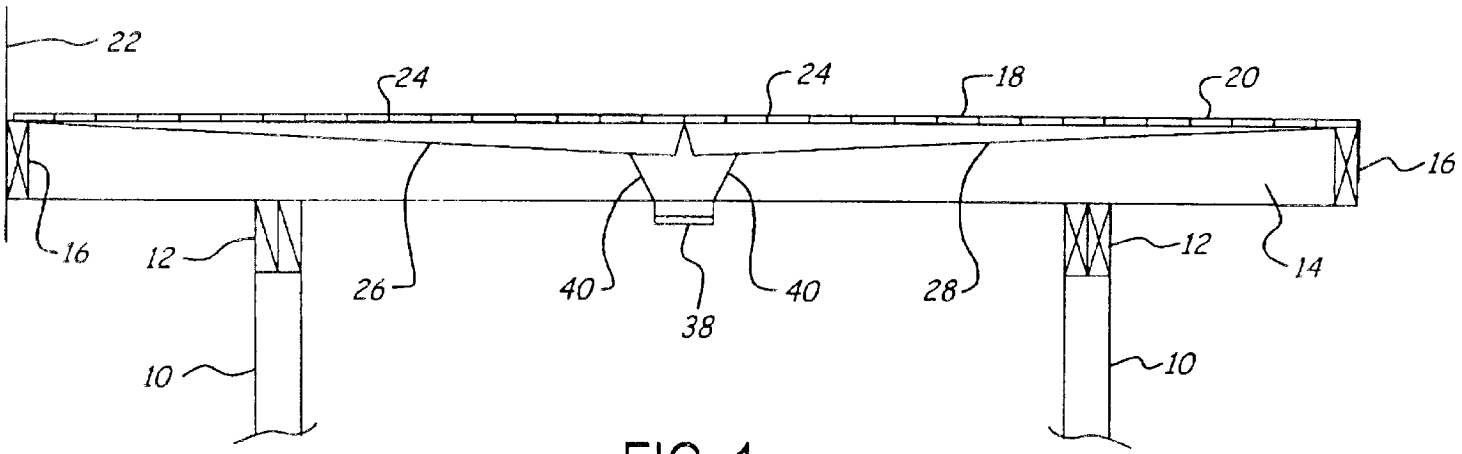
FIG. 1 illustrates a side cutaway section of the deck pan construction taken longitudinally between two joists.

Illustrated in FIG. 1 is a portion of a deck comprising vertical supports 10, horizontal beams 12 supporting joists 14 and headers 16. The joists 14 and headers 16 support the parallel planks 18 of the deck 20. Typically, the deck 20 is located adjacent a building 22, and the planks 18 are spaced apart 24 to accommodate seasonal thermal expansion and swelling.

Figure 4:
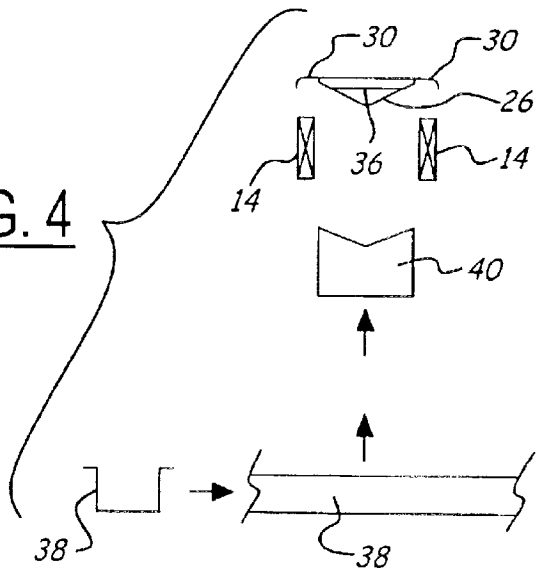
FIG. 4 is an exploded end view taken at the juncture of a deck pan with a collection trough.
Figure 2:
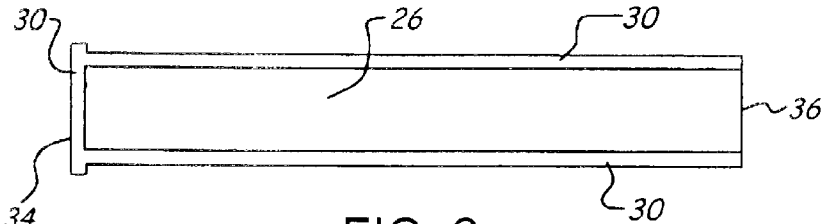
FIG. 2 is a top view of a deck pan.
Figure 3:
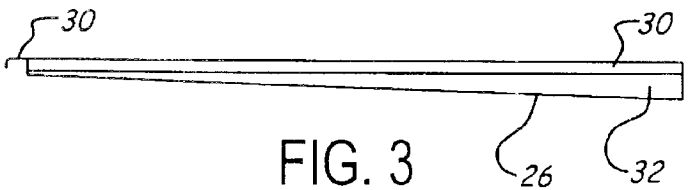
FIG. 3 is a side view of a deck pan.

Under the deck 20 between the joists 14 are a pair of formed plastic or metal pans 26 and 28 that are fastened into position before the deck 20 is assembled to the joists 14. Each pan 26 is shaped as shown in FIGS. 2, 3 and 4 wherein an overlapping peripheral flange 30 extends about each sloping side 32 and the shallow end 34 of the pan. The flange 30 overlaps on the joists 14.

The deep end 36 of the pan 26 upon installation extends over a trough 38 perpendicular to the joists 14 and therebelow. The assembly may include a varmint shield 40 as shown to prevent birds and rodents from entering the trough 38 or the pans 26. With this construction, the pans 26 and 28 gather all of the water that seeps through the gaps 24 between the planks 18 of the deck 20. The water flows to the trough 38 and from there to a downspout (not shown).

Figure 5:
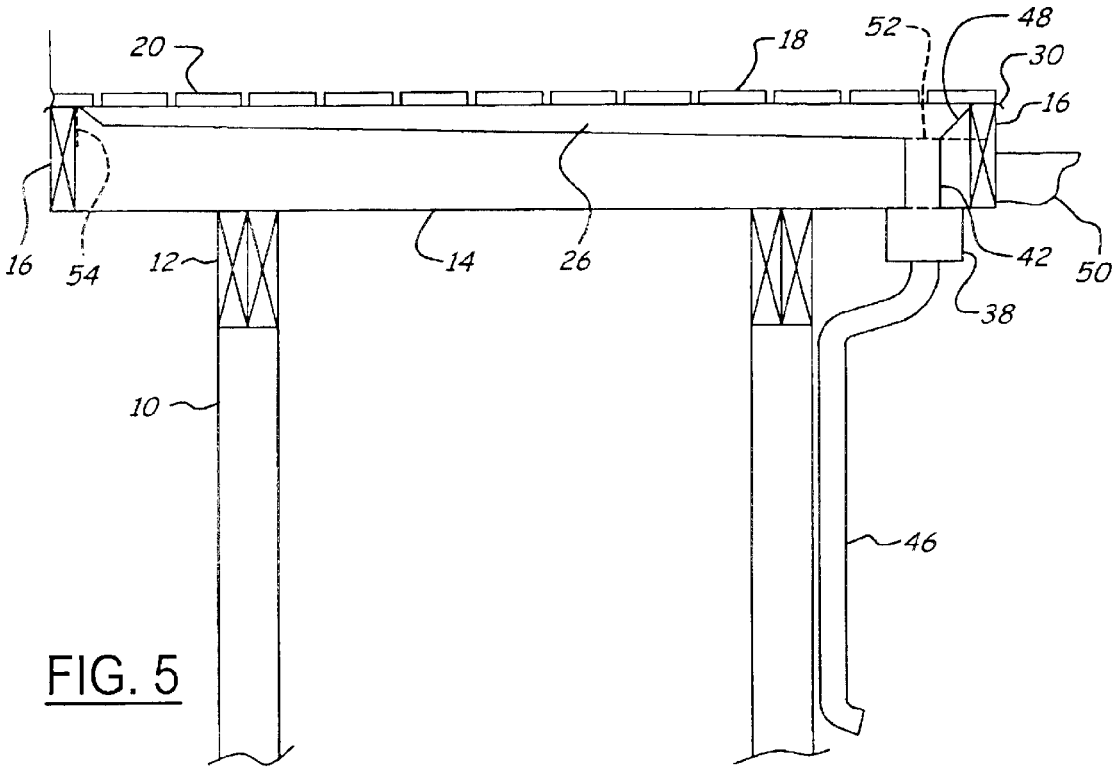
FIG. 5 illustrates a side cutaway section of an alternative form of the deck pan construction taken longitudinally between two joists.
Figure 6:
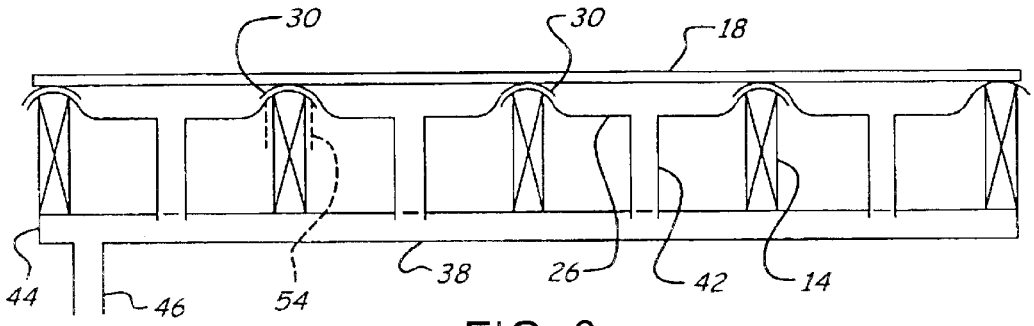
FIG. 6 is a front cutaway section taken perpendicular to FIG. 5 at the location of vertical drains to a collection trough.
Figure 15C:
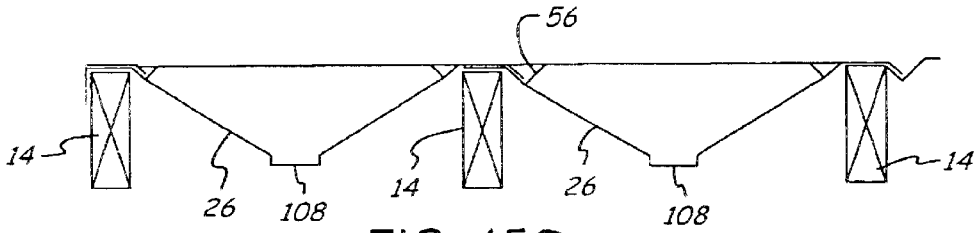
FIGS. 15A, 15B, 15C and 15D illustrate in detail a closed end deck pan.

Illustrated in FIGS. 5 and 6 is an alternative form of the pan 26 wherein the trough 38 is adjacent the header 16. The pan 26 is modified to include a drain pipe 42 leading to the trough 38. Adjacent one end 44 of the trough 38 is a downspout 46. The drain pipe 42 end of the pan 26 is closed off at 48 and flanged 30 over the header 16.

As an alternative a conventional eavestrough 50 may be mounted on the header 16 and apertures formed in the header 16 to allow water to pass through from the pan 26 into the eavestrough 50 as indicated by a dashed line 52. Where pans 26 and the other features are to be added to an existing deck 20 without removal of the planking 18, the flanges 30 may be bent downwardly as indicated by dashed lines at 54. Or, the pans 26 may be manufactured with downwardly extending flanges 30 specifically for retrofitting existing decks.

As specific examples the deck pans 26 can be manufactured for 16 or 24 inches on center joists 14 and in lengths of 4 to 10 feet to accommodate decks of various widths from the building 22. The deck pans 26 are V-shaped and formed with at least one quarter inches per foot slope leading to the trough 38 to prevent pooling and stagnant water in the pans. The trough 38 is either formed or mounted to provide at least one-quarter inches per foot slope also.

Figure 7:
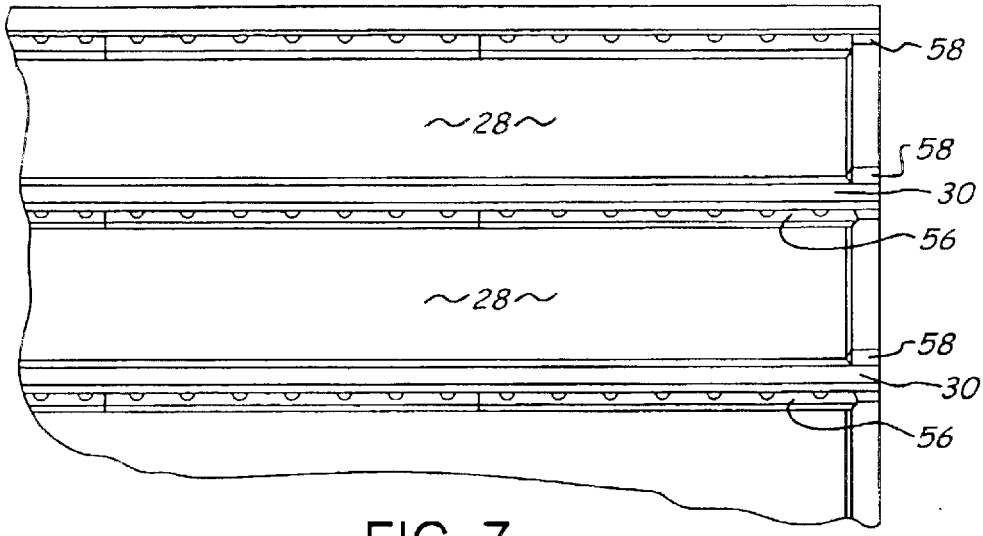
FIG. 7 is a partial top view of the installed deck pans prior to installation of the decking.

FIG. 7 illustrates the deck with deck pans 28 installed. The flanges 30 overlap, however, in this embodiment the fasteners are hidden, and deck planking brackets 56 are also attached by the hidden fasteners. Notches 58 are also formed in the flanges 30 to drain any water that collects above the headers 16. FIGS. 8 through 11 detail the construction shown in FIG. 7 as follows.

Figure 8:
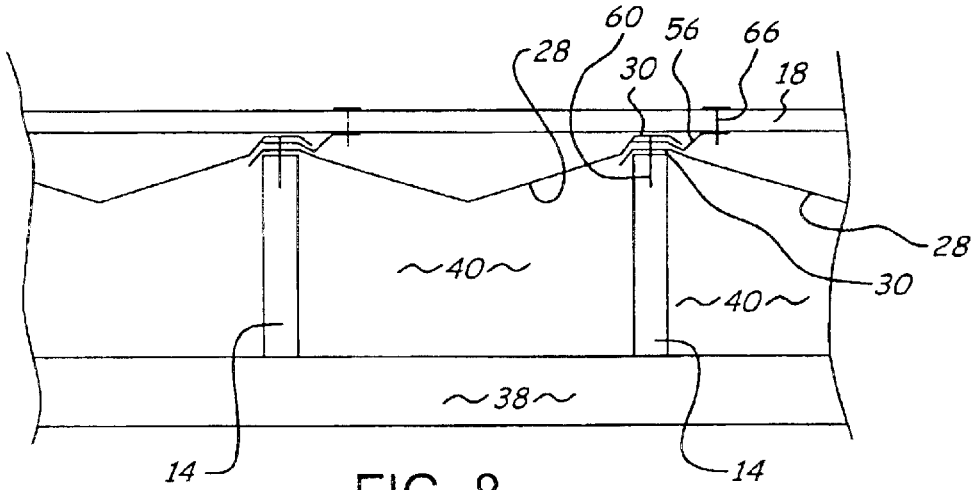
FIG. 8 is a partial section above a collection trough illustrating a protective deck installation.
Figure 11A:
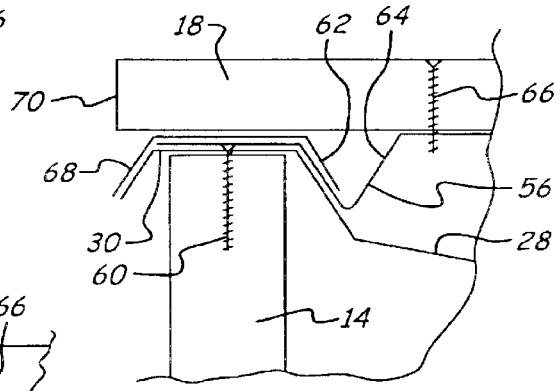
FIGS. 11A and 11B illustrate detailed attachments with the bracket of FIG. 10.
Figure 11B:
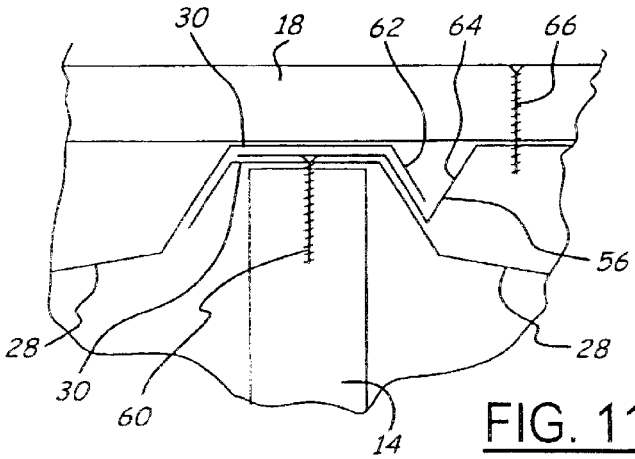

In FIGS. 8 and 11, parallel joists 14 support deck planking 18 and deck pans 28 as above, however, the lowermost flange 30 and bracket 56 there above are fastened by a hidden nail or screw 60. The screw 60 is covered by the flange 30 of the next adjacent deck pan 28. The uppermost flange 30 of the next adjacent deck pan 28 includes a lip 62 extending into the V-notch 64 of the bracket 56. A second screw 66 attaches the deck planking 18 to the bracket 56 at a location offset from the joist 14. Where the joist 14 is a rim joist as shown in FIG. 11A, a rim joist cover 68 protects the screw 60. The bracket 56 provides the additional advantage of spacing screw 66 further from the deck plank end 70 to reduce the likelihood of splitting the plank 18.

Figure 9A:
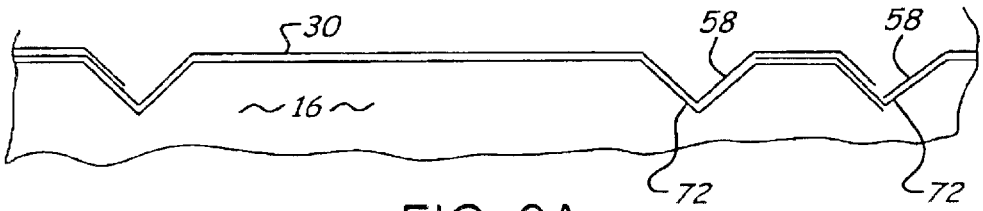
FIGS. 9A, 9B and 9C illustrate installation of the deck pans at the headers.
Figure 9C:
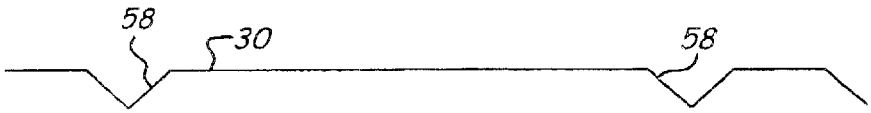
Figure 9B:
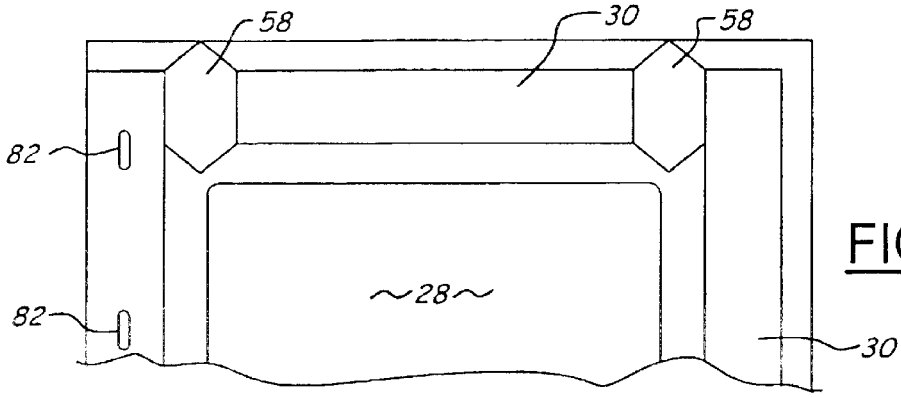

As shown in FIG. 9, to protect the header 16 the flange 30 is formed with drainage notches 58. The notches 58 allow any water that collects above the header 16 to drain into the deck pan 28. The header is notched at 72, as shown in FIG. 9A, to accommodate the notches 58. FIG. 9C illustrates a section through the flange 30 at the notches 58.

Figure 10B:
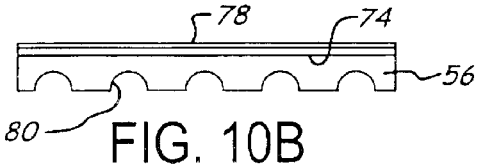
FIGS. 10A, 10B and 10C illustrate an attachment bracket.
Figure 10A:
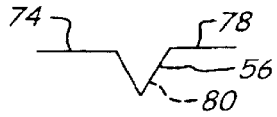
Figure 10C:
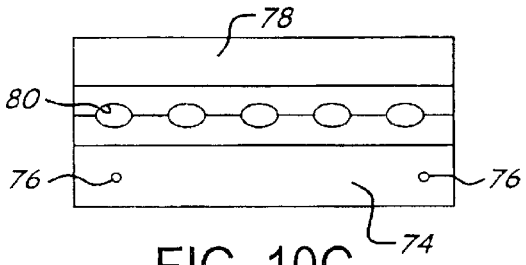

In FIG. 10, the bracket 56 is shown separately and comprises a V-shape having a flange 74 with fastener holes 76 to one side and a blank flange 78 to the other side. At the bottom of the V are holes 80 to permit water to drain from the V-shape into the deck pan there below. The flange 78 is preferably slightly higher than the flange 74 to accommodate the upper flange 30 as shown in FIG. 11. The holes 76 are placed to match the oblong holes 82 shown in FIG. 9B.

Figure 12A:
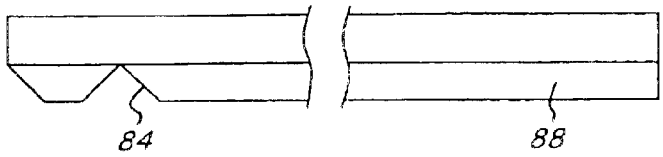
FIGS. 12A and 12B are side and top views, respectively, of header covers to lap over the brackets of FIG. 10.
Figure 12B:
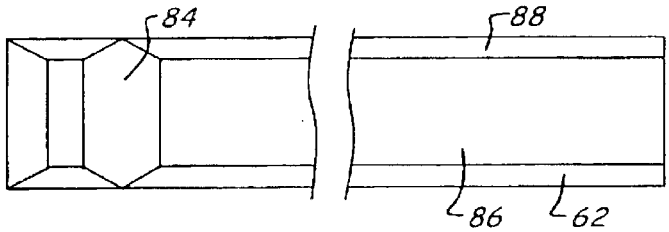

FIG. 12 illustrates the rim joist cover 68 of FIG. 11A. The rim joist cover 68 may be notched 84 periodically for drainage but otherwise is flat 86 with lips 88 and 62 to either side for shedding moisture and protecting the underlying rim joist 14.

Figure 13:
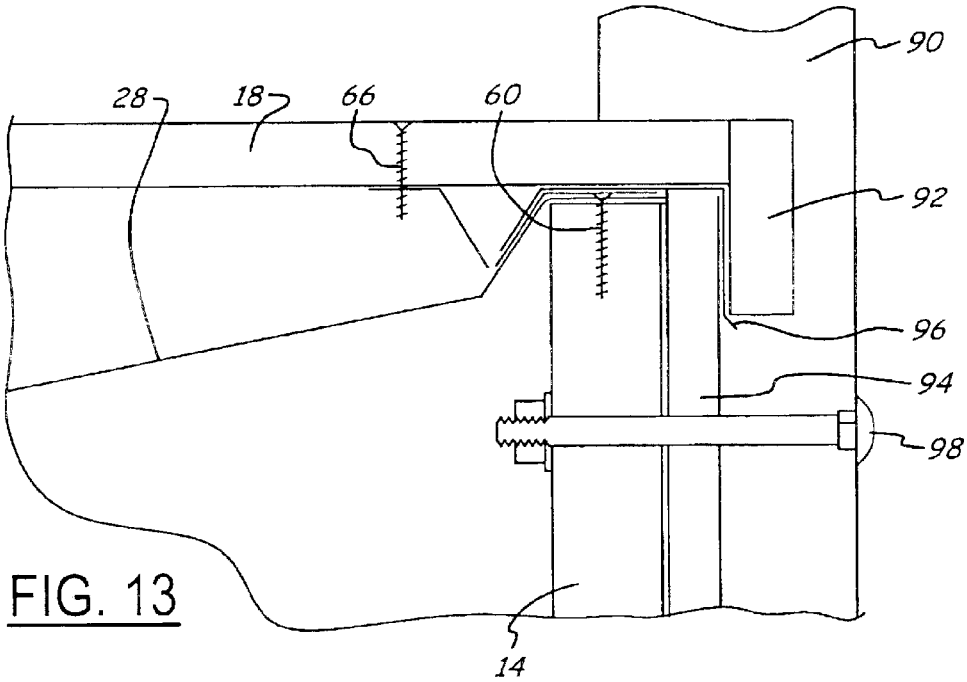
FIG. 13 illustrates installation of the deck pan at an outside header.

As shown in FIG. 13, where there are railing posts 90 and trim boards 92 and 94, the rim joist cover 96 is modified to protect not only the rim joist 14 but also the trim board 94 that is bolted 98 to the rim joist along with the post. The construction is otherwise as shown above.

Figure 14A:
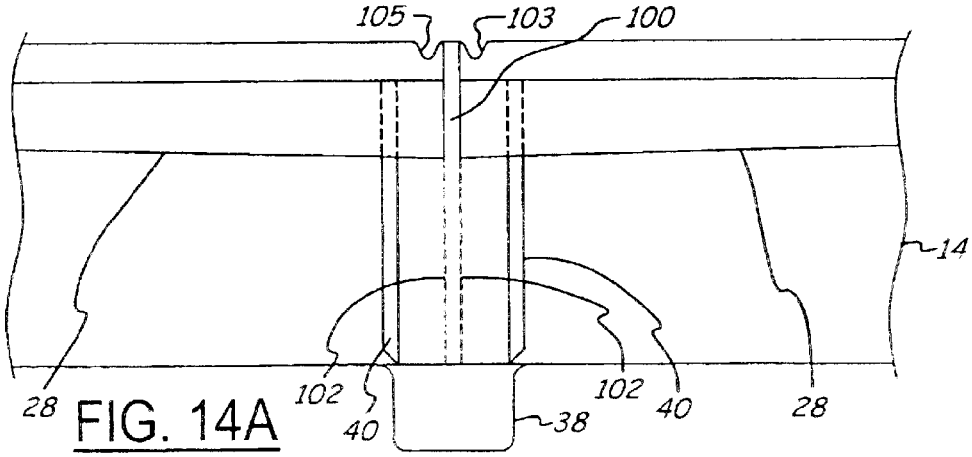
FIGS. 14A and 14B illustrate vertical views of alternative attachments of deck pans to the varmint shields.

In FIG. 14A, two deck pans 26 and 28 come together with a gap 100 there between. The deck pans 26 and 28 have flanges with overlapping notches 103, 105 fitted within v-notches in the joint (FIG. 14A). Water can fall through the gap 100 to the drainage trough 38 there below. Where varmint shields 40 are installed between the deck pans 26 and 28 and the drainage trough 38, wind cannot blow and spray the failing water. Where no varmint shields are installed, screens 102 descending from the gap 100 can help control water flow to the drainage trough 38.

Figure 14B:
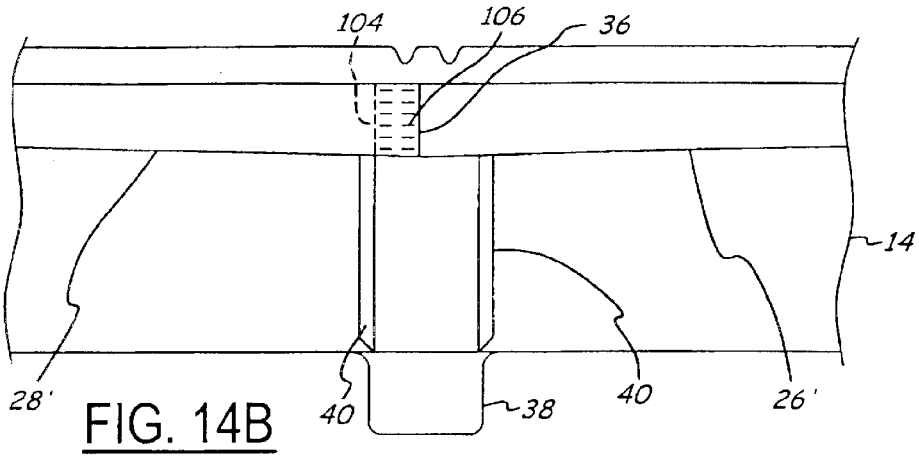
Figure 15A:
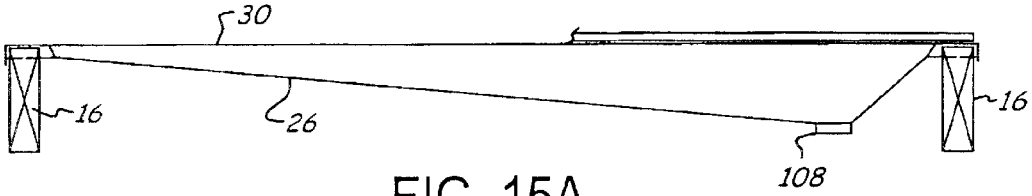
Figure 15B:
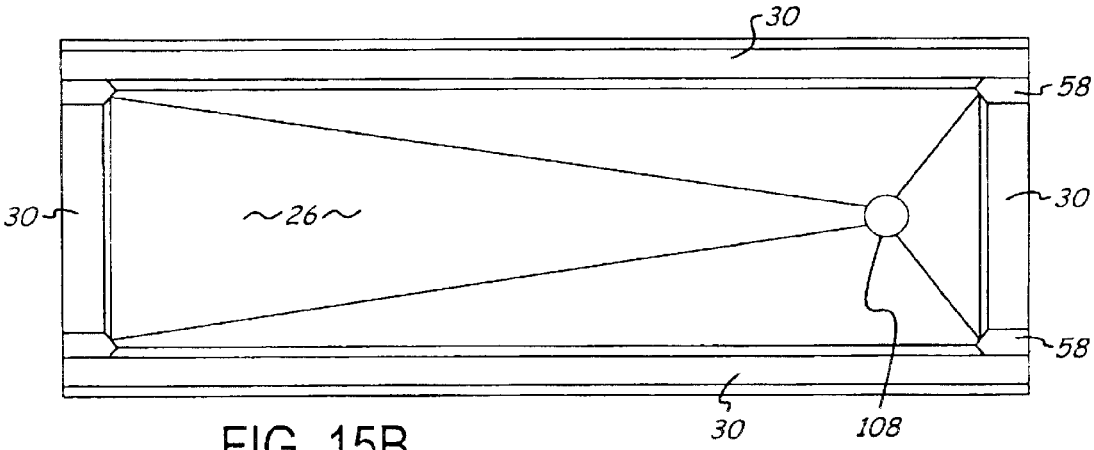
Figure 15D:
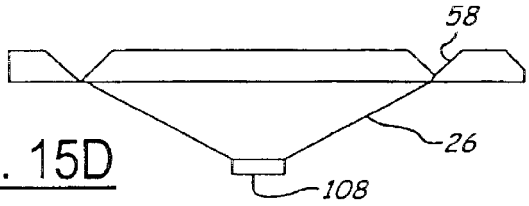

FIG. 14B offers a simpler solution where water spray is not a problem. The bottom of one deck pan 26' extends 104 over the bottom of deck pan 28'. The bottom of deck pan 26' includes raised portions 106 to permit water from both pans to easily pass underneath deck pan 26' and fall from the end 36 of deck pan 28' down into the drainage trough.

FIG. 15 further details the construction of FIGS. 5 and 6. The FIG. 15 construction is particularly suited to installations where the deck is enclosed on three sides by walls thus requiring the deck pan flange 30 to extend on all four sides of the deck pan 26. The drain hole 108 is spaced from the entire flange 30. The peripheral construction comprising overlapping flanges 30 and brackets 56 is as disclosed above. The drain holes 108 may lead to individual drain pipes or a drainage trough perpendicular to the joists.

FIG. 16 illustrates deck pans 110 adapted for use with composite deck surfaces 112. As shown, the deck pans 110 fit under the outside legs 114 of the deck surfaces 112 to collect water falling through the gaps 116 between the legs. A variety of devices can be used to retain the deck surfaces 112 and deck pans 110 to the joists 118. In FIG. 16A, barbed fastening clips 120 grip the center legs 122 of the deck surfaces 112. The clips 120 are screwed 124 to the joists 118. In FIG. 16B, wire clips 126 are screwed 128 to the joists 118 and fit in holes 130 in the center legs 122. FIG. 16C details placement of the screw 128 against the bottom of the ring 132 to force 134 the clip 126 downward tightening the deck surface 112 to the joist 118 as the ring 132 engages the bevel under the screw head.

FIG. 17 shows a modified composite deck surface 136 wherein the deck pan 138 is integral with the deck surface. As above, water flows through the gap 140 between the deck surfaces, and the deck surfaces are clipped 142 by the center legs 144 to the joist 118 below.

In FIG. 18A, metal deck units comprise deck surfaces 146 atop integral deck pans 148. The deck pans 148 are fastened to the joists by twisted straps 150. The deck surfaces 146 overlap the deck pans 148 in the same manner as shown for the composite surfaces in FIG. 17. The straps 150 can be pre-riveted 152 to the metal deck units and pivoted and twisted into position as the deck units are installed. FIG. 18B illustrates a deck unit with the strap 150 down but not twisted. The deck surface 146 may have plastic snap on surfaces as shown.

What is claimed is:

1. A deck pan and bracket arrangement in combination with an open deck wherein the open deck includes a plurality of joists and a plurality of deck planks, said deck pan arrangement comprising:

a pan for placed between said joists underneath said planks, said pan having a first and second lateral flanges which overlap the top of adjacent joists; and a bracket having a first portion overlapping said pan first flange and having a fastener connecting sad bracket and said first flange with said joist, and said bracket having a fastener connection with said plank offset from said joist.

2. A deck pan arrangement in combination with an open deck as described in claim 1 wherein said pan second flange overlaps said bracket first portion.

3. A deck pan arrangement in combination with an open deck as described in claim 1 wherein said bracket has a v-notch with a first flange for sad first portion and a second flange for a second portion for fastener connection with said plank.

4. A deck pan arrangement in combination with an open deck as described in claim 3 wherein said bracket second flange is higher than said bracket first flange.

5. A deck pan arrangement in combination with an open deck as described in claim 3 wherein said bracket has vent holes in said v-notch.

6. A deck pan arrangement in combination with an open deck as described in claim 1 wherein said deck has a header board connected to at least one of said joists and wherein said pan has a third flange covering said header board.

7. A deck pan arrangement in combination with an open deck as described in claim 6 said pan third flange is notched and said header is notched to accommodate said pan third flange notch.

8. A deck pan arrangement in combination with an open deck as described in claim 3 wherein said deck has a trim board attached to said joist and sad second flange extends over said trim board.

9. A deck pan arrangement in combination with an open deck is described in claim 1 wherein two adjacent joist have a first pan sloping in a first direction and a second pan sloping in a second direction toward said first pan and wherein said second pan extends over said first pan.

10. A deck pan arrangement in combination with an open deck as described in claim 9 wherein said joist has a notch and said first and second pans first flanges are notched adjacent to one another to fit within said notch and said second pan first flange overlaps said first pan first flange.

* * * * *